US008240771B2

(12) United States Patent
Diffrient

(10) Patent No.: US 8,240,771 B2
(45) Date of Patent: Aug. 14, 2012

(54) MESH CHAIR COMPONENT

(75) Inventor: Niels Diffrient, Ridgefield, CT (US)

(73) Assignee: Humanscale Corporation, New York, NY (US)

( * ) Notice: Subject to any disclaimer, the term of this patent is extended or adjusted under 35 U.S.C. 154(b) by 760 days.

(21) Appl. No.: 11/129,226

(22) Filed: May 13, 2005

(65) Prior Publication Data

US 2005/0264087 A1 Dec. 1, 2005

Related U.S. Application Data

(60) Provisional application No. 60/570,611, filed on May 13, 2004.

(51) Int. Cl.
*A47C 7/02* (2006.01)

(52) U.S. Cl. ..... 297/452.56; 297/452.64; 297/451.9

(58) Field of Classification Search ..... 297/452.64, 297/463.2, 452.56, 452.34, 452.33, 452.35, 297/452.36, 284.3, 452.62, 440.11, 284.1, 297/452.6, 451.9, 45, 16.1
See application file for complete search history.

(56) References Cited

U.S. PATENT DOCUMENTS

| | | | | | |
|---|---|---|---|---|---|
| 2,179,805 | A | * | 11/1939 | Trubitz | 297/225 |
| 2,266,505 | A | * | 12/1941 | Thomas | 297/228.1 |
| 2,313,878 | A | * | 3/1943 | Kline | 297/226 |
| 2,324,902 | A | | 7/1943 | Benzick et al. | |
| 2,456,797 | A | | 12/1948 | Sheldrick | |
| 2,497,395 | A | | 2/1950 | Cramer, Sr. | |
| 2,778,408 | A | | 1/1957 | Krikorian | |
| 2,838,095 | A | | 6/1958 | Deaton | |
| 2,859,799 | A | | 11/1958 | Moore | |
| 2,859,801 | A | | 11/1958 | Moore | |
| 3,205,010 | A | * | 9/1965 | Schick | 297/452.36 |
| 3,333,811 | A | | 8/1967 | Matthews | |
| 3,337,267 | A | | 8/1967 | Rogers, Jr. | |
| 3,399,906 | A | | 9/1968 | Portnoff | |
| 3,450,435 | A | | 6/1969 | Stephens | |
| 3,540,776 | A | * | 11/1970 | Wilson | 297/253 |
| 3,624,814 | A | * | 11/1971 | Borichevsky | 297/82 |
| 3,630,572 | A | * | 12/1971 | Homier | 297/452.6 |
| 3,709,557 | A | | 1/1973 | Light | |

(Continued)

FOREIGN PATENT DOCUMENTS

CN 1207882 A 2/1999

(Continued)

OTHER PUBLICATIONS

PCT/US2006/023834, Seating Apparatus with Reclining Movement, Humanscale Corporation, Written Opinion issued Jun. 30, 2008.

(Continued)

*Primary Examiner* — David Dunn
*Assistant Examiner* — Erika Garrett
(74) *Attorney, Agent, or Firm* — Jones, Walker, Waechter, Poltevent, Carrere & Denegre, LLP

(57) ABSTRACT

A mesh chair component having contours that support a user appropriately can be made by combining a plurality of mesh panels to form the component. For instance, in a preferred embodiment of the present inventions, three preformed mesh panels are combined to form the back rest of a chair that provides its user with lumbar support without the necessity of additional structural support. In an alternative embodiment of the present invention, mesh panels are used in combination with a beneficially contoured frame to provide a chair seat with a waterfall front.

43 Claims, 9 Drawing Sheets

U.S. PATENT DOCUMENTS 3,774,967 A * 11/1973 Rowland ..... 297/447.3
3,904,242 A * 9/1975 Koepke et al. ..... 297/452.6
3,916,461 A 11/1975 Kerstholt
3,924,893 A * 12/1975 Ferrara ..... 297/452.46
3,939,565 A 2/1976 Bush
3,947,069 A 3/1976 Lusch
4,082,348 A * 4/1978 Haury ..... 297/45
4,270,798 A 6/1981 Harder, Jr.
4,379,589 A 4/1983 Marino
4,408,800 A 10/1983 Knapp
4,411,469 A 10/1983 Drabert et al.
4,429,917 A 2/1984 Diffrient
D274,675 S 7/1984 Diffrient
4,471,995 A * 9/1984 Wisniewski ..... 297/411.2
4,478,454 A 10/1984 Faiks
4,479,679 A 10/1984 Fries et al.
4,502,729 A 3/1985 Locher
4,579,385 A * 4/1986 Koenig ..... 297/184.12
4,583,778 A * 4/1986 Liebhold ..... 297/56
4,603,907 A * 8/1986 Witzke ..... 297/452.56
4,639,042 A 1/1987 Lange et al.
4,685,730 A 8/1987 Linguanotto
4,709,962 A 12/1987 Steinmann
4,709,963 A 12/1987 Uecker et al.
4,732,424 A 3/1988 Uredat-Neuhoff
4,744,603 A 5/1988 Knoblock
4,761,033 A 8/1988 Lanuzzi et al.
4,765,679 A 8/1988 Lanuzzi et al.
4,796,952 A 1/1989 Piretti
4,842,333 A 6/1989 Meiller
4,877,291 A 10/1989 Taylor
4,883,320 A * 11/1989 Izumida et al. ..... 297/452.56
4,943,114 A 7/1990 Piretti
4,966,411 A 10/1990 Katagiri et al.
4,988,145 A 1/1991 Engel
5,013,089 A * 5/1991 Abu-Isa et al. ..... 297/452.64
5,015,031 A 5/1991 Horenkamp
5,018,791 A 5/1991 Zapf
5,035,466 A 7/1991 Mathews et al.
5,080,318 A 1/1992 Takamatsu et al.
5,150,948 A 9/1992 Volkle
5,251,958 A 10/1993 Roericht et al.
5,261,723 A 11/1993 Hosoe
5,288,138 A 2/1994 Stulik et al.
5,292,097 A 3/1994 Russell
5,314,237 A 5/1994 Koepke et al.
5,354,120 A 10/1994 Volkle
5,366,274 A 11/1994 Roericht et al.
5,383,712 A 1/1995 Perry
5,486,035 A 1/1996 Koepke et al.
5,496,094 A * 3/1996 Schwartzkopf et al. ..... 297/45
5,503,455 A * 4/1996 Yang ..... 297/377
5,534,330 A * 7/1996 Groshens ..... 428/198
5,549,358 A * 8/1996 Muller ..... 297/452.64
5,582,459 A 12/1996 Hama et al.
5,584,422 A * 12/1996 Bond-Madsen ..... 224/155
5,725,276 A 3/1998 Ginat
5,725,277 A 3/1998 Knoblock
5,747,140 A * 5/1998 Heerklotz ..... 428/131
5,806,930 A 9/1998 Knoblock
5,842,739 A * 12/1998 Noble ..... 297/219.12
5,845,970 A * 12/1998 Schwartz ..... 297/451.9
5,931,531 A 8/1999 Assmann
5,988,757 A * 11/1999 Vishey et al. ..... 297/452.31
6,003,942 A 12/1999 Haas
6,012,774 A 1/2000 Potter
6,035,901 A 3/2000 Stumpf et al.
6,050,646 A 4/2000 Stenzel et al.
6,059,368 A 5/2000 Stumpf et al.
6,086,153 A 7/2000 Heidmann et al.
6,102,482 A * 8/2000 Dettoni et al. ..... 297/452.56
6,113,186 A * 9/2000 Holmes et al. ..... 297/248
6,125,521 A 10/2000 Stumpf et al.
6,234,578 B1 * 5/2001 Barton et al. ..... 297/452.41
6,247,753 B1 6/2001 Alvestad
6,386,634 B1 5/2002 Stumpf et al.
6,394,549 B1 5/2002 DeKraker et al.
6,439,665 B1 * 8/2002 Cvek ..... 297/440.11
6,540,950 B1 * 4/2003 Coffield ..... 264/257
6,550,866 B1 * 4/2003 Su ..... 297/452.42
6,561,580 B1 * 5/2003 Bergey ..... 297/216.1
6,585,323 B2 * 7/2003 Gaylord et al. ..... 297/440.11
6,588,842 B2 7/2003 Stumpf et al.
6,604,784 B1 8/2003 Bosman et al.
6,634,717 B2 10/2003 Kown
6,685,267 B1 2/2004 Johnson et al.
6,688,698 B1 * 2/2004 Chou et al. ..... 297/411.36
6,702,390 B2 3/2004 Stumpf et al.
6,709,058 B1 3/2004 Diffrient
6,722,735 B2 4/2004 Lucci et al.
6,722,741 B2 4/2004 Stumpf et al.
6,722,742 B2 * 4/2004 Potes et al. ..... 297/452.56
6,726,286 B2 4/2004 Stumpf et al.
6,729,691 B2 * 5/2004 Koepke et al. ..... 297/452.56
6,733,080 B2 * 5/2004 Stumpf et al. ..... 297/411.36
6,817,668 B2 11/2004 DeKraker et al.
6,886,890 B2 * 5/2005 Rowland et al. ..... 297/452.56
6,923,505 B2 * 8/2005 Siminovitch et al. .... 297/411.35
6,926,355 B2 * 8/2005 Le Gette et al. ..... 297/16.2
6,942,300 B2 * 9/2005 Numa et al. ..... 297/452.56
6,959,965 B2 11/2005 Diffrient
6,966,606 B2 * 11/2005 Coffield ..... 297/452.56
D512,574 S 12/2005 Tsai
6,983,997 B2 * 1/2006 Wilkerson et al. ..... 297/452.56
7,001,111 B2 * 2/2006 Maxwell et al. ..... 405/302.6
D516,828 S 3/2006 Tsai
7,014,269 B2 * 3/2006 Coffield et al. ..... 297/452.56
D527,920 S 9/2006 Giugiaro
D544,735 S 6/2007 Su
D573,817 S 7/2008 Su
D580,199 S 11/2008 Su
D596,430 S 7/2009 Su
D600,477 S 9/2009 Su
2001/0028188 A1 10/2001 Stumpf et al.
2001/0030457 A1 10/2001 Gregory
2002/0038970 A1 4/2002 Leng et al.
2002/0190564 A1 12/2002 Coffield et al.
2003/0071509 A1 4/2003 Neil et al.
2005/0258678 A1 11/2005 Wilkerson et al.
2005/0275265 A1 12/2005 Deimen et al.
2006/0022506 A1 2/2006 Chan
2006/0103222 A1 5/2006 Caruso et al.
2007/0001497 A1 1/2007 Diffrient

FOREIGN PATENT DOCUMENTS

GB 577369 5/1946
GB 1291263 A 10/1972
GB 1428185 3/1976
GB 2059758 A * 4/1981
JP 12-17173 11/1937
JP 51-25736 5/1993
JP 20018785 1/2000
JP 2001-137065 5/2001
JP 30855994 2/2002
JP 2002120618 4/2002
JP 2002-177091 6/2002
JP 20030004000 1/2003
WO 0193907 A1 12/2001
WO 2004037046 5/2004
WO WO - 2004/037046 A1 5/2004
WO 2005/112704 12/2005
WO 2005112704 A2 12/2005
WO 2005112704 A3 12/2005
WO 2008/020824 A3 2/2008

OTHER PUBLICATIONS

EP 08005519, Seating Apparatus with Reclining Movement, Humanscale Corporation, Search Report issued Sep. 26, 2008.

PCT/US2005/016550—Mesh Chair Component—EPO as International Searching Authority—Written Opinion dated Mar. 28, 2006.

PCT/US2005/016550—Mesh Chair Component—EPO as International Searching Authority—International Preliminary Examination Report dated Sep. 21, 2006.

EPO—Application No. 05747961.0—Mesh Chair Component—Examiner's Action dated Apr. 26, 2007.

EPO—Application No. 05747961.0—Mesh Chair Component—Examiner's Action dated Oct. 5, 2007.
EPO—Application No. 05747961.0—Mesh Chair Component—Examiner's Action dated May 5, 2007.
CA—Application No. 2566429—Mesh Chair Component—Examiners Action dated Apr. 29, 2008.
U.S. Appl. No. 07/898,907—Office Chair—filed on Jun. 15, 1992.
English abstract of JP Publication No. 2003-000400; Publication Date: Jan. 7, 2003; Application No. 2001-190106; Filing Date: Jun. 22, 2001; Applicant: Itoki Crebio Corp; Inventors: Fukuhara Atsushi, Matsumoto Hiroichi, Okada Kazuhisa; "Body Supporter Such as Chair and Manufacturing Method Thereof"; p. 1 of 1.

* cited by examiner

MESH CHAIR COMPONENT

CROSS-REFERENCE TO RELATED APPLICATION

This application claims the benefit of U.S. Provisional Application No. 60/570,611, filed May 13, 2004, which is incorporated herein in its entirety.

FIELD OF THE INVENTION

The present invention relates to chairs that include a mesh support surface, and more particularly, to the back rest, armrest, head rest, or seat of such a chair.

BACKGROUND

Chairs with backs comprising a mesh supporting surface forming a yieldable resilient surface that deforms when sat on have been previously known. It is believed that such structures provide the chair with greater comfort than chairs having backs or seats of a solid construction. One example of a mesh-type chair is found in U.S. Pat. No. 6,059,368 to Stumpf et al.

Because the mesh used to cover seats and seat backs has been made of a single expanse of fabric stretched across a frame, seats and seat backs made from mesh have been limited to being substantially flat. A flat seat and back rest geometry, however, does not provide the user with the appropriate and adequate ergonomic support that a chair needs to provide. For instance, heretofore, mesh back rests have not provided users with lumbar support without the addition of some type of solid support structure. Similarly, heretofore, mesh seats have not provided users with a seat front that tapers down, commonly referred to as a waterfall, without the addition of some type of solid support structure. (See e.g., U.S. Pat. No. 6,604,784 to Bosman, et al.) Consequently, chair manufacturers have not previously been able to provide the benefits of a mesh seat, arm rest, head rest, or back rest in a chair that provides the user with the appropriate ergonomic support.

The missing ergonomic support in conventional mesh chairs is recognized, but attempts to solve the problem have centered on providing a solid structural component. For example, there is a product sold separately (under the name PostureFit™) to add lumbar support structure to the chair described in the Stumpf et al. '638 patent.

The lack of appropriate ergonomic support in conventional mesh chairs is further illustrated by their inability to provide adequate support to the various shapes of users' bodies because of the uncontrolled stretch ability of the mesh. Mesh chairs were believed to provide superior comfort arising from the ability of the mesh to stretch to conform to the shape of the user's body. Such belief failed to recognize, however, that the uncontrolled stretch of the mesh also conformed to unhealthy seating conformations arising from, for example, poor posture, and failed to provide beneficial support where necessary, such as the lumbar area.

In the non-analogous dressmaking art, it is known to use darts, eases, and other assists in order to create contours. Such contours are coordinated with the seam lines. For example, U.S. Pat. No. 3,939,565 to Bush describes such arrangements. However, until now, it has not been known that darts, eases and other assists could be employed to obtain desirable and beneficial contours in a mesh chair component.

Accordingly, it would be advantageous to provide a chair having a mesh support surface where the mesh has a contour that adapts to the user's body. It would be further advantageous to provide such a chair in coordination with a contoured frame for the relevant portion of the chair.

BRIEF SUMMARY OF THE INVENTION

According to the present invention, there is provided a chair having at least one component comprising at least one membranous panel, wherein said component is beneficially contoured to support a user. Said contour can be provided by a component frame supporting said at least one membranous panel or by combining a plurality of panels to form the component.

According to one embodiment of the present invention, there is provided a chair component comprising at least one membranous panel capable of displacement for accommodation of various body shapes.

According to another embodiment of the present invention, the chair component, for example, the seat, arm rest, head rest, or back rest, is comprised of a plurality of panels. Typically, the chair component comprises three or more panels. It is preferred that the chair component of the present invention has no more than ten panels.

In one embodiment of the present invention, each panel is cut, or otherwise formed, in a shape so that when the several panels are combined, together they form a chair component, such as a seat, back rest, or headrest that is capable of beneficially adapting to the user's shape.

The several panels are capable of being combined in a conventional fashion. For example, the panels can be combined by sewing the panels together, by welding them together (such as by sonic welding), or by using an adhesive to bind the panels together. Typically, the chair component surface of the present invention has at least two straight or curvilinear seams. In a preferred embodiment, the seams are curvilinear. It is preferred that the chair component surface of the present invention has fewer than ten seams between panels.

When the several panels are combined, such as in a back rest embodiment, they form a back rest that provides support to the seat user's back. For instance, a back rest made according to the present invention provides a mesh back rest having lumbar support without the necessity of an additional solid structure. Thus, a mesh back rest according to the present invention can have contours without a pad applying pressure to the mesh to achieve beneficial contours.

As used herein, the term "panel contour" refers to a three dimensional shape of a chair component that results from the combination of a plurality of membranous panels. The "panel contour" differs from the three dimensional shape produced by a contoured frame.

According to another embodiment of the present invention, the chair component comprises a single mesh panel covering a contoured component frame. According to this embodiment, the chair component is particularly useful as a chair seat. The seat is thus particularly adapted to be substantially contoured to the various users' body shapes and distribute pressure of the user's lower body.

According to yet another embodiment of the present invention, the chair component comprises a head rest. According to this embodiment, the head rest comprises at least one mesh panel that is contoured to substantially conform to the shape of the user's head. Preferentially, the head rest comprises one or more panels.

According to a further embodiment of the present invention, a chair component, such as a seat, arm rest, back rest or head rest, is formed from a plurality of panels from a membranous material using a contoured component frame.

In some embodiments of the present invention, mesh chair components are combined with other parts to form a chair. For example, a mesh seat according to the invention could be combined with a back rest and a plurality of legs to form a chair. In this embodiment of the invention, one or more components of the chair can be a mesh component according to the invention.

According to another embodiment of the invention, there is provided a chair comprising a chair pedestal, a base mounted on the pedestal, a seat mounted on the base, and a back rest attached to the base. Preferably, the pedestal contains a height adjustment mechanism such as a gas spring. Additionally, the back rest could be pivotally connected to the base. In one such embodiment, the back rest is pivotally connected to the base at a point roughly corresponding to the lumbar region of a user's back. Obviously, such a base would require an upward extension so at to form the pivot connection in that area. Preferably, the back rest comprises at least three membranous panels. Further, the seat can also comprise one or more membranous panels.

The present invention also encompasses further embodiments wherein there is provided a chair having at least one component comprising a contoured mesh panel. In one embodiment, the chair is a swivel chair comprising a base pivotally supporting a seat, optionally including a back, arms, and a head rest, wherein at least one of said seat, back, arms, and headrest is comprised of at least one contoured mesh panel. In another embodiment, the chair comprises four legs stationarily attached to a seat, optionally including a back and arms, wherein at least one of the seat, back, and arms comprise at least one contoured mesh panel.

BRIEF DESCRIPTION OF THE DRAWINGS

Figure 1:
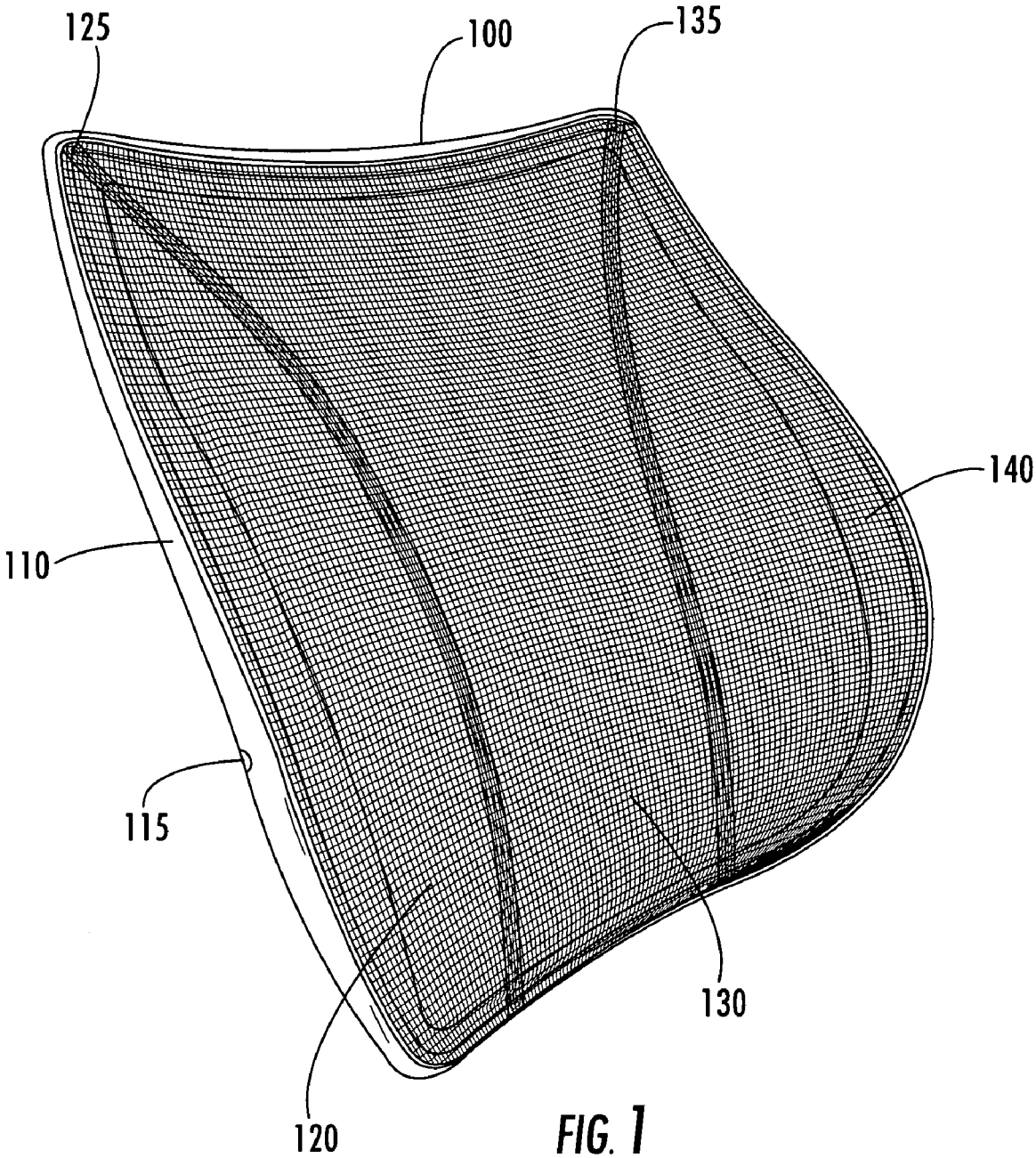
Figure 2:
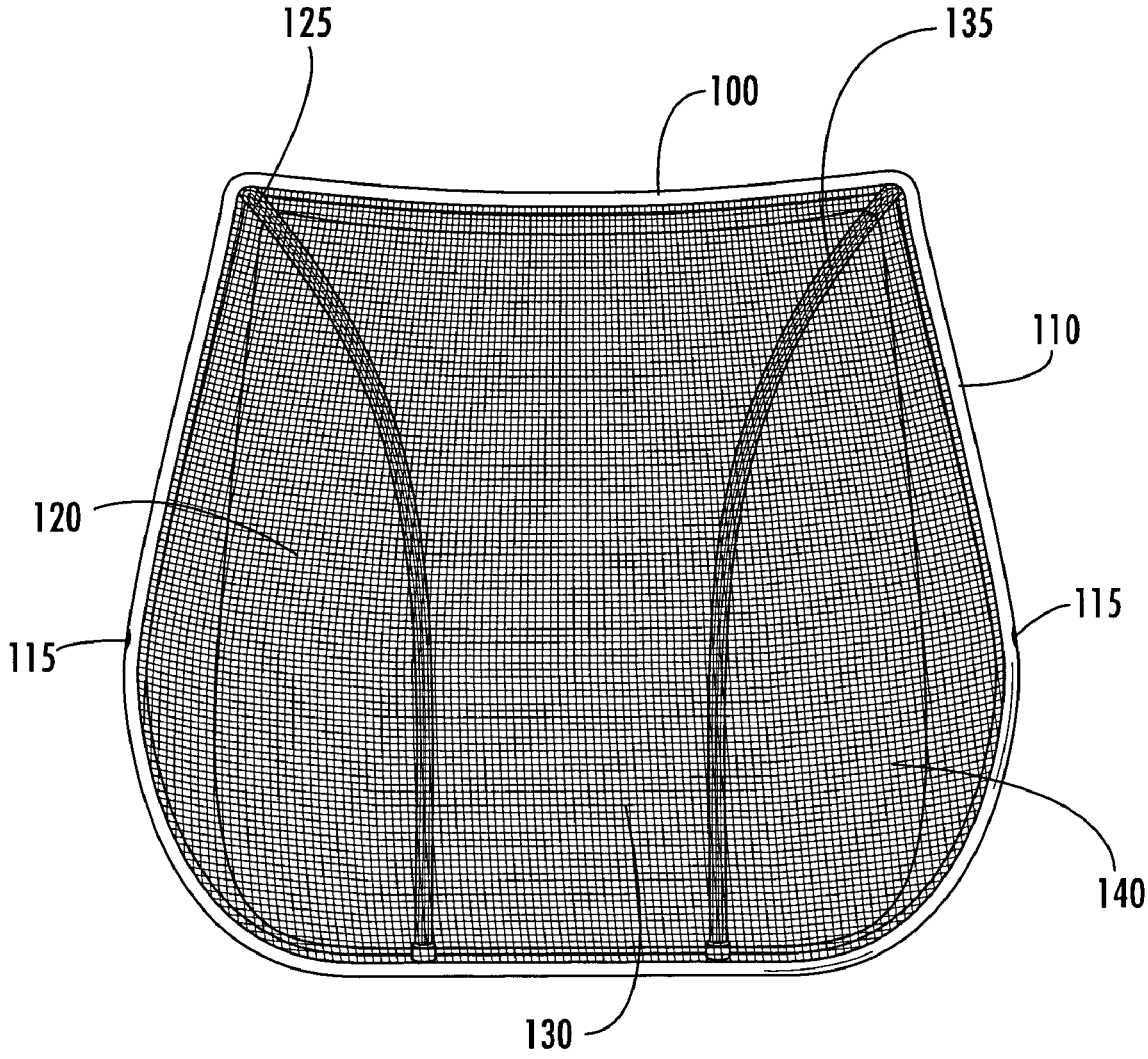
Figure 3:
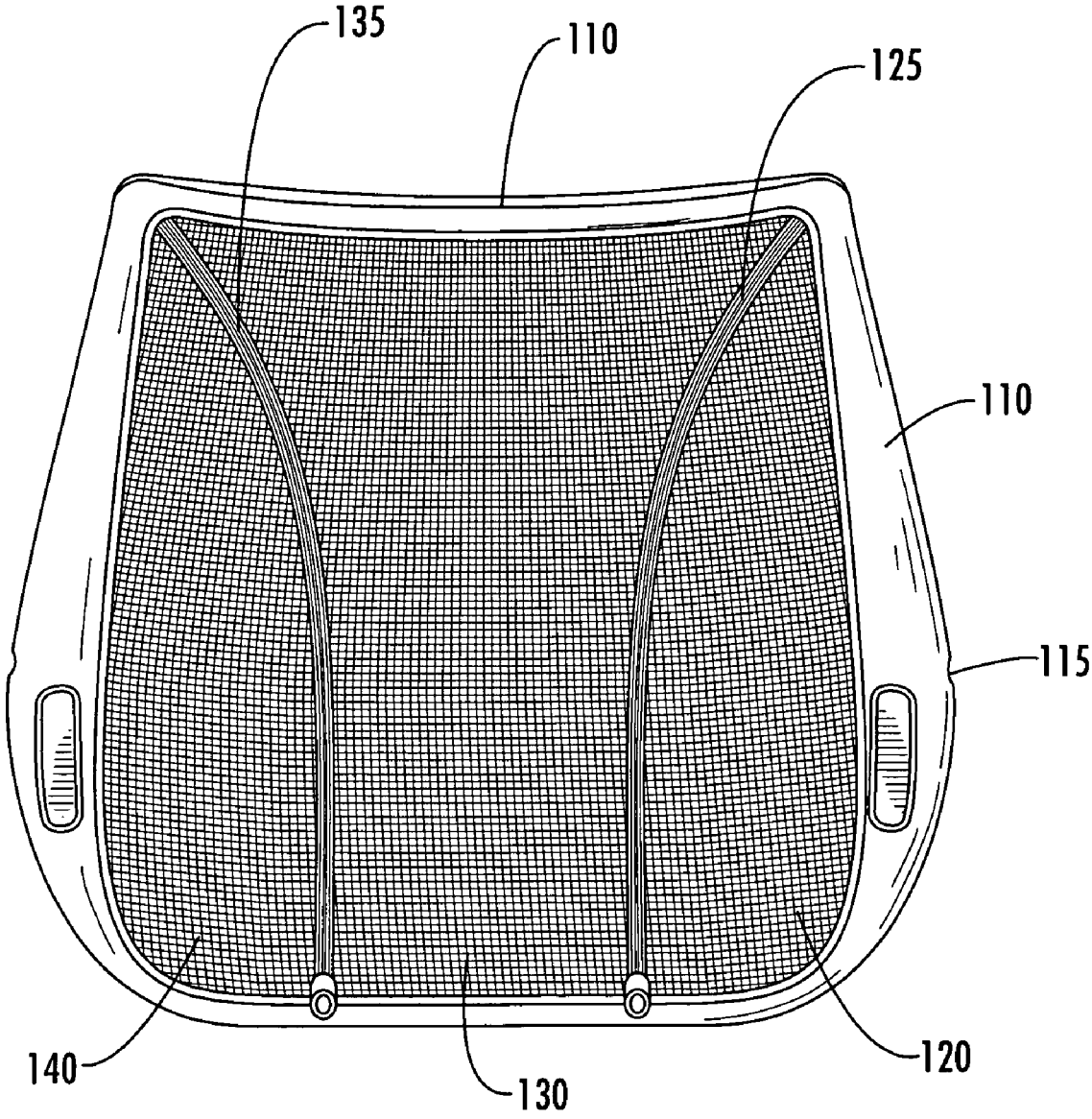
Figure 4:
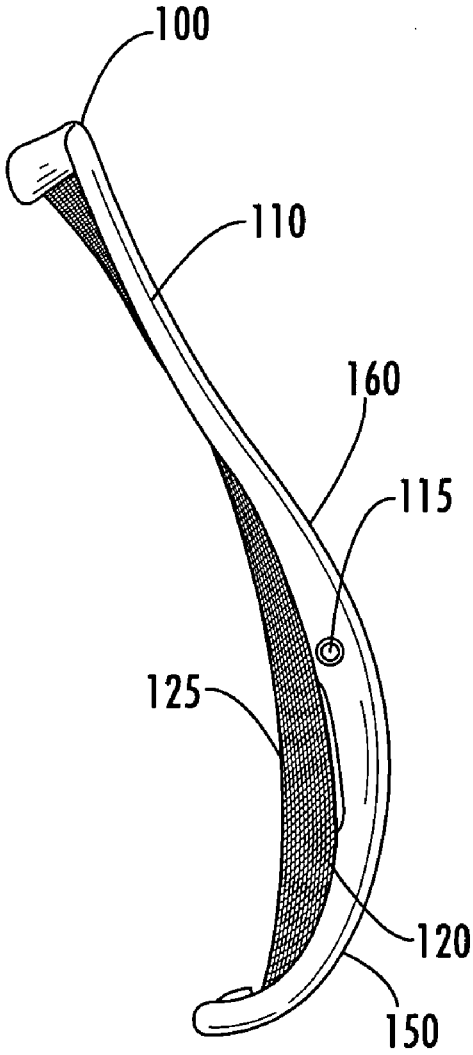
Figure 5:
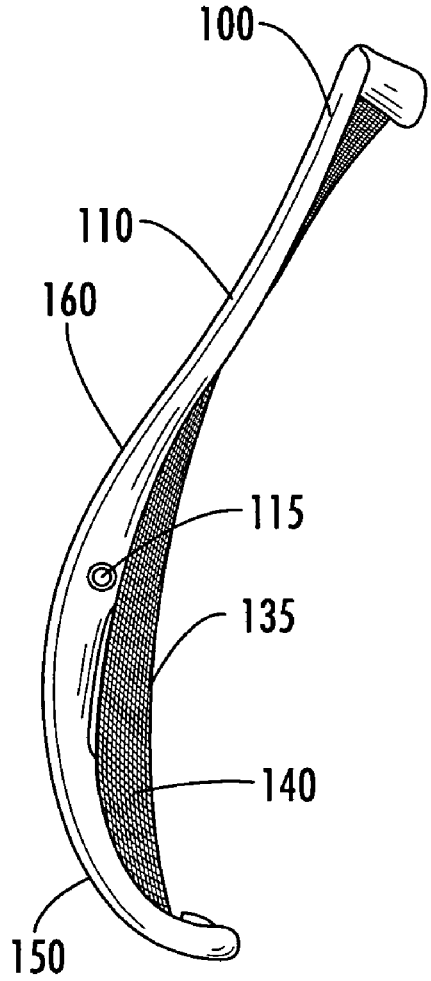
Figure 6:
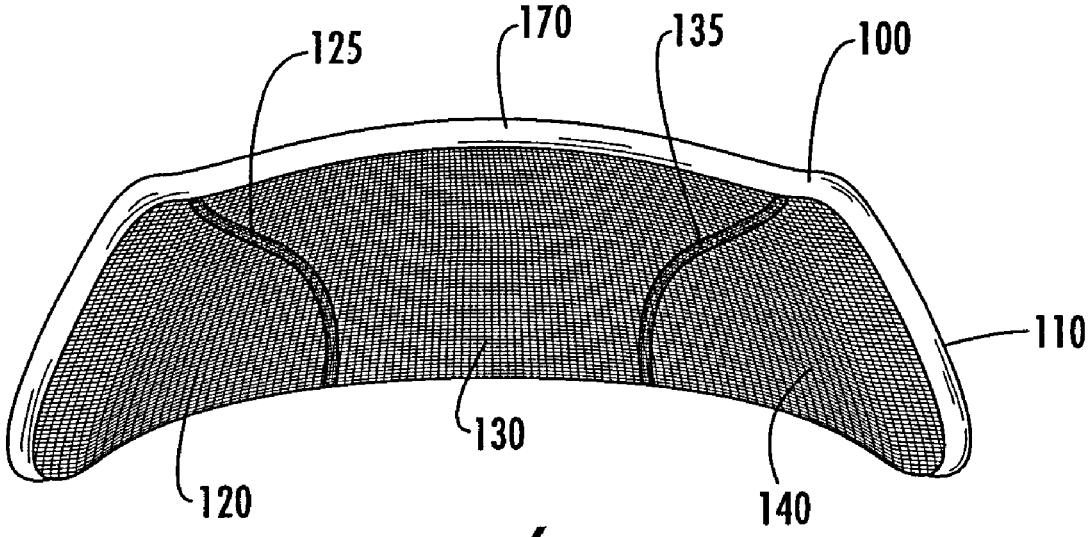
Figure 7:
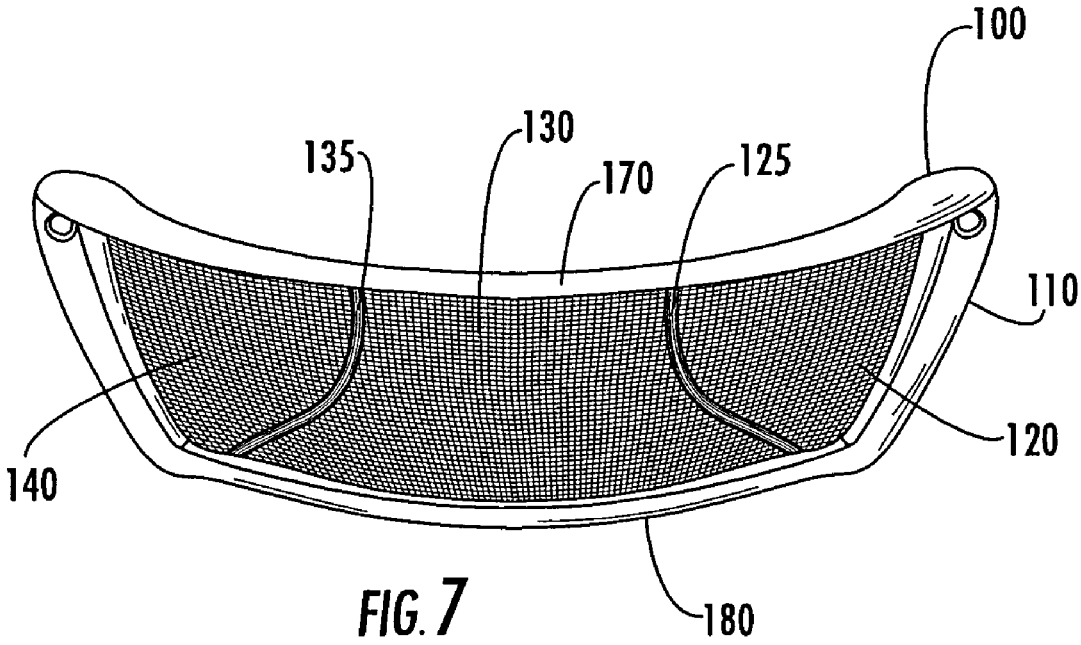
Figure 8:
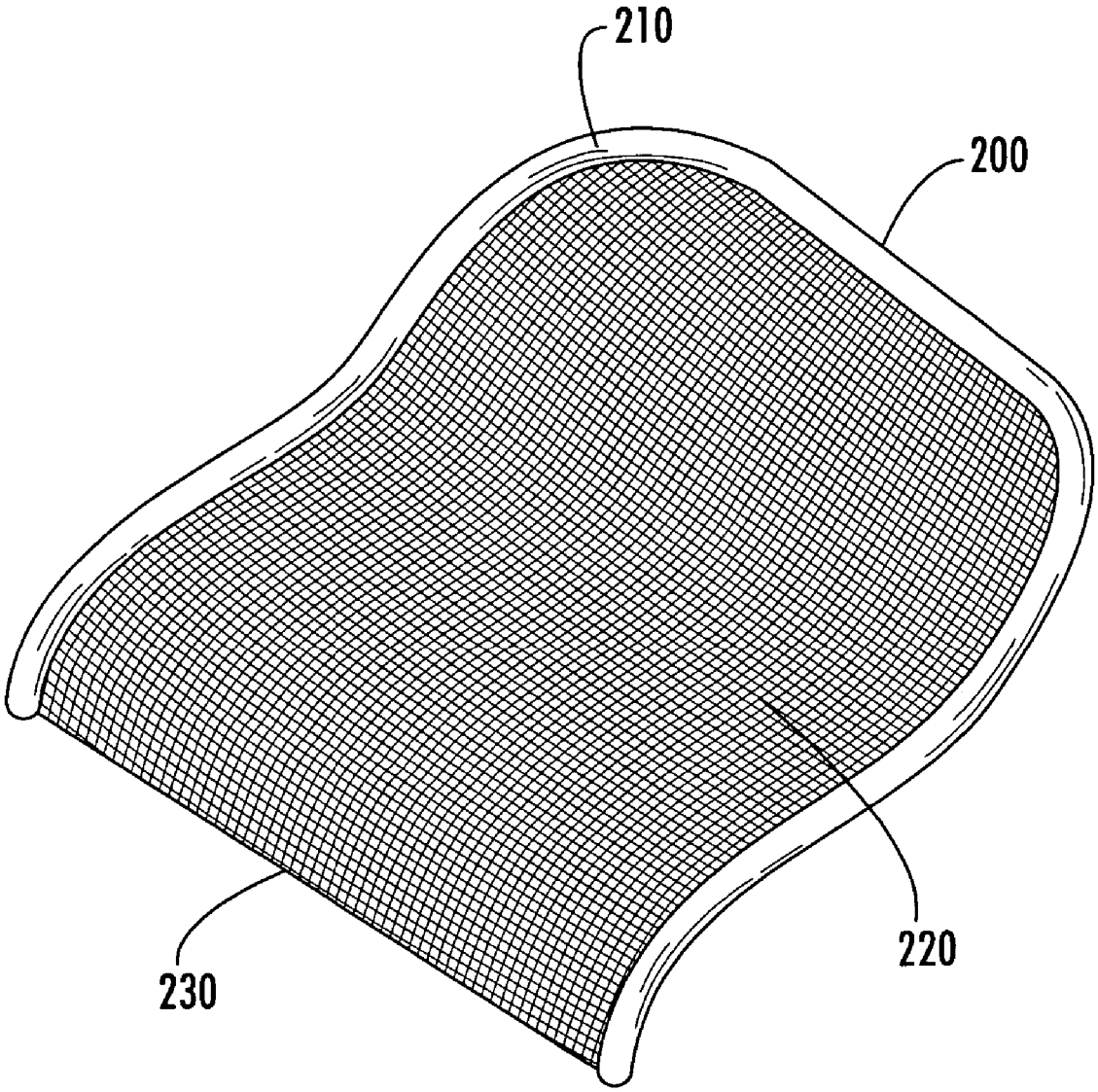
Figure 9:
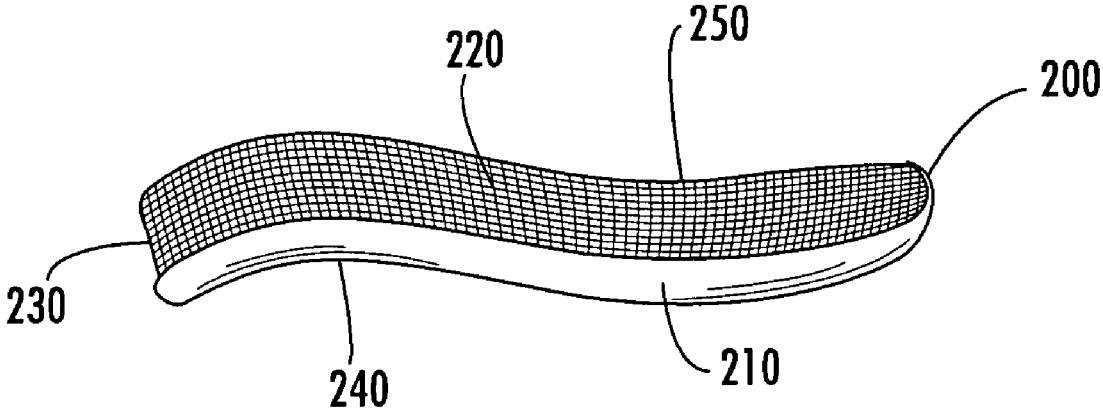
Figure 10:
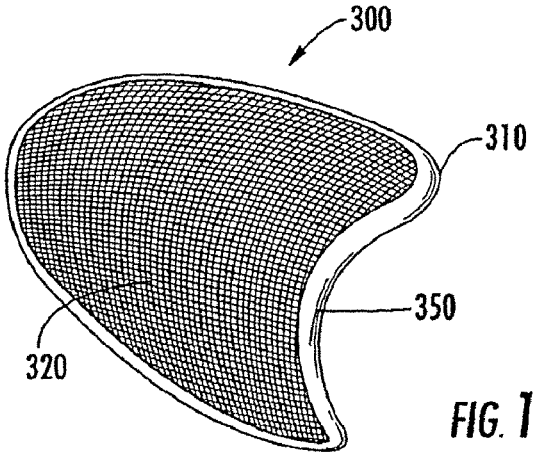
Figure 11:
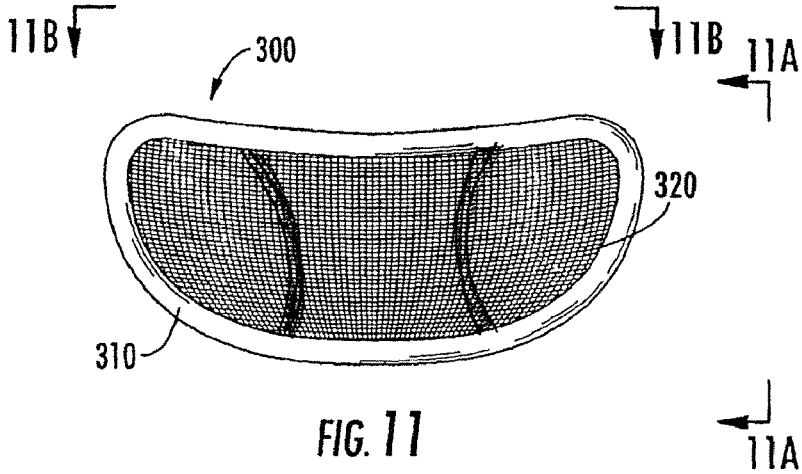
Figure 11A:
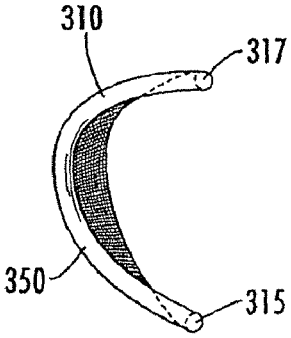
Figure 11B:
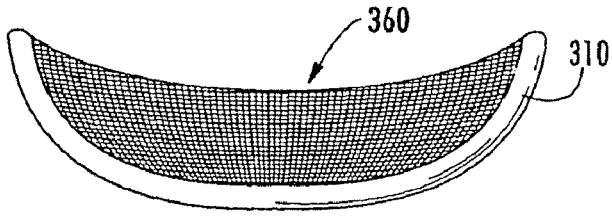
Figure 12:
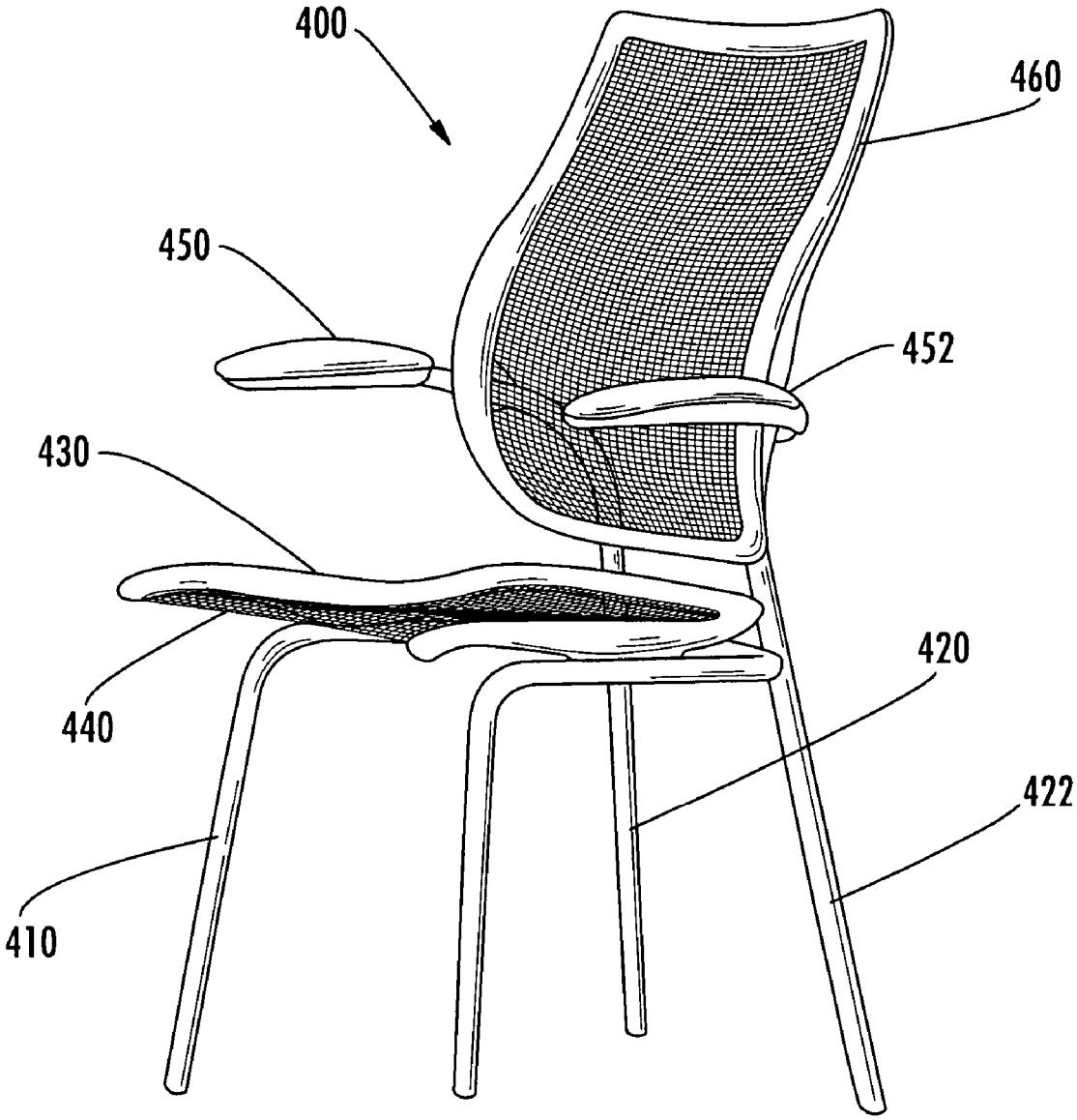

Having thus described the invention in general terms, reference will now be made to the accompanying drawings, which are not necessarily drawn to scale, and wherein:

FIG. 1 is a front perspective view of a mesh back rest according to the present invention;

FIG. 2 is a front view of a mesh back rest according to the present invention;

FIG. 3 is a rear view of a mesh back rest according to the present invention;

FIG. 4 is a right side view of a mesh back rest according to the present invention;

FIG. 5 is a left side view of a mesh back rest according to the present invention;

FIG. 6 is a front view of the top portion of a mesh back rest according to the present invention;

FIG. 7 is a rear view of the top portion of a back rest according to the present invention;

FIG. 8 is a front perspective view of a mesh seat according to the present invention;

FIG. 9 is a left side view of a mesh seat according to the present invention;

FIG. 10 is a front perspective view of a mesh head rest according to the present invention;

FIG. 11 is a rear view of a mesh head rest according to the present invention;

FIG. 11A is a side view of the mesh head rest of the invention shown in FIG. 11 along line A-A of FIG. 11;

FIG. 11B is a top view of the mesh head rest of the invention shown in FIG. 11 along line B-B of FIG. 11; and FIG. 12 is a front perspective view of a mesh component chair according to the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention provides chair components, and chair made using the components, wherein the chair components include a mesh portion. The mesh chair components, such as chair seats, back rests, head rests, and chair arms, are particularly advantageous in that the mesh is beneficially contoured to provide ergonomic support to the user. Furthermore, the mesh chair components are particularly designed to be adaptable to the various body shapes of multiple users while still providing ergonomic support. The mesh chair components of the invention are particularly useful in that they can be incorporated into a number of various embodiments. For example, one or more of the mesh components of the invention can be incorporated into an office chair (such as including casters), a standard four-leg chair, household seating, public seating facilities (such as stadium seating, movie theatre seating, arena seating, and the like), public transportation seating (such as airplane seating, train seating, bus seating, and the like), professional service seating (such as a dental exam chair), and other similar or related seating apparatuses. The mesh chair components of the invention can also be incorporated into other types of vehicle seating, such as automobile seating. Accordingly, the present invention also encompasses all of the various seating embodiments described above incorporating at least one mesh component as described herein.

FIG. 1 shows a chair back rest 100 according to one embodiment of the present invention. The periphery of the chair back rest 100 is a component frame 110, which includes an aperture 115. In one embodiment of the present invention, the aperture 115 is capable of receiving a pin, thereby allowing connection the chair back rest 100 to additional chair components, such as to an arm extending from a chair base (not shown).

In one embodiment of the invention, as shown in FIG. 1, the mesh back rest is made from three mesh panels, namely right panel 120, center panel 130, and left panel 140. Right panel 120 and left panel 140 are substantially mirror images of one another; however, in further embodiments of the invention, this is not necessarily required. Center panel 130 has a shape that is substantially different from that of either right panel 120 or left panel 140. Preferably, center panel 130 is encouraged into an appropriate vertical contour by tension exerted by right panel 120 and left panel 140, to which center panel 130 is joined.

According to this embodiment of the invention, the various panels, 120, 130, and 140, can be adapted to form beneficial contours for receiving various users' body shapes. For example, where a raised contour is desired, as in the lumbar area, the width of right panel 120 and left panel 140, in proportion to center panel 130, is such that the tension on the panels from the force provided by the component frame 110 lifts center panel 130 to the correct contour. In areas of the back rest 100 where it is beneficial to have contours that are less pronounced, such as, for example, in the area of the back rest 100 adaptable for receiving the shoulder area of a user, less tensile force is required. Accordingly, for such areas, right panel 120 and left panel 140 are narrower and center panel 130 is wider. This effect is illustrated in FIG. 1, where center panel 130 is narrower in the lower area of the back rest

100 adaptable to the lumbar area of a user, and becomes wider in the upper area of the back rest 100 adaptable to the shoulder area of a user.

As provided by the above description, it is therefore possible, according to the invention, to prepare a mesh chair component, such as a back rest, having beneficial contours in desirable areas of the component. Accordingly, the invention allows for preparation of specialized components that are beneficially contoured for special needs users. Additionally, the chair components can be made to have contours in positions, such as generally in the lumbar region, that are beneficial for a wide range of users.

The panels used to make the chair components of the invention, such as the back rest of the embodiment described above, can be made from any conventional membranous fabric. The panels are especially useful as a mesh fabric, such as nylon, polyester, or other synthetic or natural fibers or skins. For example, the panels can be made from leather that has been selectively perforated to substantially emulate a mesh-type material. As such, the perforations could be patterned or unpatterned to impart additional desirable qualities to the panels. Alternatively, the mesh fabric could be comprised of a blend of materials, such as a polyester/nylon blend. Desirably, each of the panels is made from the same type of fabric. In one particular embodiment of the invention, each of the panels is made from a polyester weave mesh.

It is preferable that the material used in preparing the mesh component according to the present invention have a limited stretch ability. Accordingly, the material should have a stretch ability of less than about 10%, preferably less than about 8%, more preferably less than about 6%. It is generally preferred for the material to have a stretch ability on the order of about 5%. Such limited stretch allows for the most effective use of the contours generated according to the invention. The limited stretch allows for maintenance of the support generated by the contours while still providing the comfort of the mesh.

One method of measuring the stretch ability of a membranous material is to take an about two by about twelve inch piece of the membranous material and hang the material vertically. An about twenty pound weight is attached to the bottom of the membranous material. After the weight/material combination has come to equilibrium (for example, after about a half hour), the length of the "stretched" material is measured and compared to the length of the material before the weight was applied. As used herein, a material is of limited stretch ability if the ratio of the length of the "stretched" material to the initial length is less than about 1.10, preferably less than about 1.08, more preferably less than about 1.06. A material of limited stretch ability particularly useful according to the invention has a ratio of around 1.05.

It is further desirable that the membranous material not be pulled too tightly within the outer component frame. Given the benefits provided by the limited stretch ability of the material used in the invention, it is desirable to limit the stretching of the material during manufacture of the chair component, including insertion of the mesh into the outer component frame. In other words, pre-stretching of the material is not required since the limited stretch ability of the material in connection with the contouring of the panels provides sufficient tension without the need for pre-stretching.

Generally speaking, in accordance with a back rest embodiment of the invention, the vertical radius at the lumbar area should be within the range of about 9 inches to about 15 inches. Additionally, the horizontal radius at the lumbar area should be within the range of about 13 inches to about 16 inches and should be within the range of about 22 inches to about 26 inches at the shoulder area of the back rest.

The use of limited stretch material is advantageous over the use of material having a greater stretch ability as it allows for displacement of the material, rather than stretching, which is more accommodative. Mesh material with a stretch ability that is not limited allows the material to conform to the position of the user, which facilitates, or even promotes, poor posture and ergonomically unsound seating. By use of limited stretch material, undesirable positions of the body are not possible as they would be with material having a greater stretch ability. Use of a material having limited stretch ability with modest tension across the component frame, as described above, allows for displacement of the material that accommodates the differing body shapes of various users while maintaining beneficial support. For example, a lumbar contour in a mesh back rest according to the present invention can adjust to the individual back shape and size of various users because the contour can be displaced to correspond to the area of the natural lumbar contour of the user, but the supportive contour of the mesh is maintained, thereby providing support, rather than just stretching without providing needed support.

In the embodiment shown in FIG. 1, right panel 120 is joined to center panel 130 by right seam 125 and center panel 130 is joined to left panel 140 by left seam 135. Seams 125 and 135 can be made by any conventional method of joining the mesh fabric including, but not limited to, sewing, welding, and gluing. In one particular embodiment, the seams are joined by ultrasonic welding.

The membranous material can be attached to the component frame by any conventional method. One preferred method is by attaching the material, such as by welding or gluing, to a flexible strip, such as a spline, and fitting the combination into a grove formed in the component frame. In one particular embodiment, the membranous material is sewn to a spline. The combination is generally fitted into the groove at a right angle to the direction of the tension on the material. The flexible strip used in attaching the material to the component frame can be made from any material commonly known for such uses, and is desirably a plastic-type extrusion, such as polyethylene or an equivalent.

FIG. 2 shows another view of the mesh component back rest according to the embodiment shown in FIG. 1. Again, about the periphery of the back rest 100 is component frame 110, and within the component frame are right panel 120, center panel 130, and left panel 140. As in FIG. 1, right panel 120 is joined to center panel 130 by right seam 125, and center panel 130 is joined to left panel 140 by left seam 135.

FIG. 3 shows back rest 100 of FIG. 2 from the obverse view. FIG. 3 provides a more detailed view of the component frame 110 according to one embodiment of the invention.

FIGS. 4 and 5 show one embodiment of the back rest 100 from the right and left sides. From these views, it can be seen that in this particular embodiment of the present invention, the component frame 110 has a curvature that provides additional contour to the back rest 100 so as to provide further support for the user. The curvature shown in these figures can be referred to as a side view curvature. As seen in each of these figures, this side view curvature begins at the bottom of the component frame. From the bottom, the frame goes, or curves, forward (shown as curvature 150). Subsequently, for example from about the lumbar region (which is about a quarter of the way up the chair back), the side view curvature inverts and heads backward (shown as curvature 160).

FIGS. 6 and 7 provide top perspective views of the back rest 100 from the front and back. From these views, it can be seen that in this particular embodiment of the present invention, the component frame 110 has a top view curvature that provides further contour to the back rest 100 so as to provide additional support for the user. For instance, both the top and the bottom edges of the component frame 110 have a concave shape (170, and 180, respectively). The concave shape 180 of the bottom edge of the component frame 110 is not visible in FIG. 6 due to the forward curvature of the component frame 110 discussed above.

While the foregoing discussion has mainly described the invention in terms of a back rest, the present invention also lends itself to additional chair components. Accordingly, chairs could be made, according to the invention, having mesh components comprising further chair parts, such as, for example, a chair seat, a chair arm, or a head rest.

FIG. 8 provides a front perspective view of a chair seat 200 according to one embodiment of the present invention. The periphery of the chair seat 200 is a component frame 210, which encompasses only three sides of the chair seat 200, thus having a substantially U-shaped conformation. The front edge 230 of the chair seat 200 is devoid of framing in order to avoid a hardened area whereby pressure could be applied to the user's body. In this manner, a more comfortable seating arrangement is provided since the comfort of the mesh component extends through the front portion of the chair seat 200 without the need of an additional structural component that could act as a pressure point on the body of the user. According to this embodiment, the chair seat 200 is comprised of a single membranous panel 220.

FIG. 9 provides a side view of the chair seat 200. As seen in this embodiment, the component frame 210 may be contoured (i.e., have a side view curvature) to improve the effect of the membranous panel 220 to distribute pressure of the user's lower body.

Accordingly, the chair seat 200 preferably has an upward curvature 240 toward the front portion of seat 200 and preferably has a downward curvature 250 toward the middle and back of seat 200. Such curvatures can be advantageously designed to receive the lower body of a user in an ergonomically correct sitting position, evenly and comfortably distributing the pressure of the user's lower body. Preferentially, the curvatures of the chair seat 200 are designed for encouraging an ergonomically correct upright posture by the user. According to this embodiment, the panel 220 is stretched side-to-side across component frame 210 with a tension that, preferentially, is greater than the tension applied to the panels of a back rest according to the present invention. A greater tension is preferred in the chair seat embodiment over the back rest embodiment as the chair seat must support the weight of the user. Further, the chair seat generally relies on the particular contouring of the component frame, while in the back rest embodiment, support is also provided by the contours formed by the multi-panel construction.

It is also preferred that the front edge 230 of the chair seat 200 have a "waterfall" effect. This effect can be achieved by appropriate contouring of the front edges of the side portions of component frame 210. For example, it is desirable that the side portions of component frame 210 be radiused downward about 1 to about 1.5 inches at the front portions.

While the foregoing discussion describes the invention in terms of individual chair components, one or more of the components can be incorporated into a chair according to the invention. A chair according to the present invention can include a mesh seat according to the above embodiment. Alternatively, a chair according to the present invention can include a seat comprising a standard cushion and upholstery. Either seat embodiment could be included in a chair comprising a back rest comprising contoured mesh panels as described herein.

FIG. 10 provides a front perspective view of a head rest 300 according to the present invention. The periphery of the head rest 300 is a component frame 310. Preferentially, the component frame 310 is contoured to improve the effect of the panel 320 in receiving the head of the user. According to the embodiment of FIG. 10, the component frame 310 has a forward curvature 350 along the horizontal axis. The head rest, as shown in the embodiment of FIG. 10, can have a single mesh panel 320 attached to component frame 310. Alternately, the head rest can have a plurality of panels, such as in the back rest embodiment described above. Desirably, when the head rest is comprised of a plurality of panels, the panels are attached such that when they are combined, they are contoured for substantially conforming to the head of a user. For example, a head rest according to this embodiment may be contoured such that it provides support at the base of the head of the user in the neck region while also receiving the more rounded back portion of the user's head. In further embodiments, the component frame of the head rest component can also have a curvature varied from the embodiment of FIG. 10 but beneficial for receiving the contoured, multi-panel mesh.

The head rest of the present invention is further illustrated in FIG. 11, which provides a front view of the head rest. Accordingly, this view illustrates a single mesh panel 320 stretched across the component frame 310. A side view of the head rest 300 along lines A-A is provided in FIG. 11A, which further illustrates the forward curvature 350 of the component frame 310 in this embodiment of the invention. Also shown according to FIG. 11A, the head rest 300 further comprises apertures 315 and 317 for receiving pins for attachment to supports (not shown). A top view of the head rest 300 along lines B-B of FIG. 11 is provided in FIG. 11B, which illustrates optional additional backward curvature 360 along the vertical axis. The additional curvature allows for maximizing the contouring ability of the head rest for receiving the head of a user and providing beneficial support.

FIG. 12 illustrates one embodiment of a chair according to the present invention. According to FIG. 12, there is provided a chair 400 having a front support piece 410 and two rear support pieces 420 and 422. According to the embodiment shown, the front support 410 is a single shaped piece acting as two front leg pieces and as a frame support for attachment of the seat frame 430. In alternate embodiments, the front support 410 could comprise two separate members as front leg pieces. As shown in FIG. 12, the seat frame 430 is substantially U-shaped having no support member along the front edge of the seat frame 430, which is beneficially contoured for supporting a user's body and covered by mesh 440.

The rear support pieces 420 and 422 function as two rear leg pieces and are preferentially attached to the front support piece 410 for added stability. In the present embodiment, the rear support pieces 420 and 422 are further adapted for use as arm supports 450 and 452. The rear support pieces 420 and 422 are also useful as supports for the back rest 460. The back rest 460 is preferentially designed to be interchangeable between different chair embodiments. Thus, the back rest 460 is preferentially made according to the embodiments previously described according to the present invention. As shown in FIG. 12, the back rest 460 comprises only a single mesh piece. However, the invention preferentially encompasses embodiments wherein the back rest 460 comprises multiple mesh pieces as described herein.

Various modifications to the chair according to FIG. 12 could be made and are envisioned by the present invention. For example, in another embodiment, chair 400 could be made without the arms 450 and 452. In such embodiment, rear support pieces 420 and 422 would preferentially terminate at some point along seat back 460. In yet another embodiment, the back rest could be a mesh component according to the present invention and the chair seat could be a conventional seat, such as a hard surface covered by foam or other padded cushioning.

Additional chair embodiments are also envisioned by the present invention. For example, a chair according to the invention could comprise a pedestal, such as one having a plurality of outwardly extending support arms. Such support arms could further comprise components for facilitating movement of the chair, such as casters. Preferentially, the pedestal includes a height adjustment mechanism. In one particular embodiment, the height adjustment mechanism is a gas spring. The pedestal could further comprise a base attached thereto capable of supporting and having attached thereto additional chair components. For example, a back rest according to the present invention could be pivotally connected to the base, such as through a pivot connecting member extending upward from the base. In a particular embodiment, the back rest is pivotally connected to the base at a point roughly corresponding to the lumbar region of a user's back. Further, the base could support a chair seat. In one embodiment, the chair seat is a mesh chair seat according to the present invention. In another embodiment, the chair seat is a conventional chair seat.

The present invention also encompasses further embodiments wherein there is provided a chair having at least one component comprising a contoured mesh panel. In one embodiment, the chair is a swivel chair comprising a base pivotally supporting a seat. The chair can optionally include a back rest, arms, and a head rest, wherein at least one of the chair seat, back rest, arms, and headrest is comprised of at least one contoured mesh panel.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A chair comprising:

a back rest including:

at least three sub-panels interconnected by at least two curvilinear seams to form a single panel having a three-dimensional contour, wherein said at least three sub-panels are each cut or otherwise formed into individual shapes such that, when they are attached together along curvilinear seams to form the single panel, those individual shapes and the curvilinear seams combine to cause the resultant single panel to have a three-dimensional panel contour, and wherein said single panel has said three-dimensional panel contour at least in the absence of an external force; and a component frame about at least a portion of the periphery of said back rest; said single panel being secured around at least a portion of its periphery to said component frame.

2. The chair of claim 1, wherein at least one of said at least three sub-panels has a non-rectangular shape.

3. The chair of claim 1, wherein said contour provides support for a user's lumbar region.

4. The chair of claim 1, wherein said component frame has a curved shape from side to side and from top to bottom.

5. The chair of claim 1, wherein said component frame has a side view curvature that curves forward, in a direction toward a seat of the chair, at a bottom portion of the frame and backward, in a direction away from the seat of the chair, near a top portion of the frame.

6. The chair of claim 1, wherein at least one of said at least three sub-panels has a stretch ability of less than about 6%.

7. The chair of claim 1, further comprising a head rest, the head rest and the back rest comprising separate components of the chair.

8. The chair of claim 7, wherein said head rest comprises one or more membranous panels.

9. The chair of claim 7, wherein said head rest comprises a plurality of panels.

10. The chair of claim 1, further comprising arms.

11. The chair of claim 10, wherein said arms are attached to said back rest.

12. The chair of claim 10, wherein said arms adjust independently of one another.

13. The chair of claim 1 further comprising a seat.

14. The chair of claim 13, wherein the seat comprises one or more mesh panels.

15. The chair of claim 14, wherein the seat further comprises a U-shaped component frame comprising a front terminus portion which radiuses downward to create a side view curvature in the front region of said seat that resembles that of a waterfall and wherein the one or more mesh panels is secured on three sides by said component frame.

16. The chair of claim 1 wherein at least one of said at least three sub-panels comprises mesh.

17. The chair of claim 1 wherein cushioning for a user is provided primarily by said single panel.

18. The chair of claim 1 wherein support for said single panel is provided primarily by said component frame.

19. The chair of claim 1 wherein support for said single panel is provided solely by said component frame.

20. The chair of claim 1 wherein support for a user is provided primarily by tension between said single panel and said component frame.

21. The chair of claim 1 further comprising a void through said component frame.

22. The chair of claim 21 wherein said single panel extends across said void.

23. The chair of claim 21 wherein said component frame is a hoop.

24. The chair of claim 1 wherein at least one of said at least three sub-panels has a stretch ability of less than about 10%.

25. The chair of claim 1 wherein the single panel is tensioned by the component frame.

26. The chair of claim 1 wherein said component frame has a three-dimensional shape and the three-dimensional contour of said single panel differs from the three-dimensional shape of said component frame.

27. The chair of claim 1 wherein said single panel provides lumbar support for a user without the necessity of a pad applying pressure to the single panel to achieve the three-dimensional contour.

28. The chair of claim 1 wherein said component frame is about the entire periphery of said back rest; and said single panel is secured around its entire periphery to said component frame.

29. The chair of claim 1 wherein said component frame forms a closed loop.

30. The chair of claim 1 wherein said single panel provides lumbar support for a user without the necessity of an additional support member to achieve a three-dimensional contour.

31. A contoured chair component comprising:

a peripheral component frame having a three-dimensional shape and an attachment mechanism for attaching said peripheral component frame to a chair; and at least three sub-panels interconnected by at least two seams to form a single panel having a three-dimensional contour, wherein the single panel is secured within said peripheral component frame and support for said single panel is provided primarily by said peripheral component frame, and wherein said three-dimensional contour of said single panel differs from the three-dimensional shape of said peripheral component frame.

32. The chair component of claim 31, wherein at least one of said at least three sub-panels has a shape that is non-rectangular.

33. The chair component of claim 31, wherein at least one of said at least three sub-panels has a shape that is not a parallelogram.

34. The chair component of claim 31, wherein said three-dimensional contour of the single panel provides a lumbar support.

35. The chair component of claim 31, wherein said peripheral component frame has a side view curvature that curves forward in a first direction at a bottom portion of the peripheral frame and backward in a second direction near a top portion of the peripheral component frame.

36. The chair component of claim 31, wherein said at least two seams comprise at least two curvilinear seams.

37. The chair of claim 31, wherein said at least three sub-panels are comprised of synthetic or natural material.

38. The chair component of claim 37, wherein said at least three sub-panels comprise a polyester weave mesh.

39. The chair component of claim 31, wherein at least one of said at least three sub-panels has a limited stretch ability.

40. The chair component of claim 39, wherein said stretch ability is less than or equal to about 5%.

41. The chair component of claim 31, wherein said sub-panels are attached to one another by a method selected from the group consisting of sewing, welding, and gluing.

42. The chair component of claim 41, wherein said sub-panels are attached by sonic welding.

43. The chair component of claim 31, wherein said peripheral component frame further comprises a groove for receiving said at least three sub-panels.

* * * * *